US009775204B2

(12) United States Patent
Kang et al.

(10) Patent No.: US 9,775,204 B2
(45) Date of Patent: Sep. 26, 2017

(54) LIGHT-EMITTING MODULE

(71) Applicant: LG INNOTEK CO., LTD., Seoul (KR)

(72) Inventors: Il Yeong Kang, Seoul (KR); Sang Hoon Lee, Seoul (KR); Jong Won Jeon, Seoul (KR); Keun Tak Joo, Seoul (KR); Tae Young Choi, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/300,489

(22) PCT Filed: Mar. 23, 2015

(86) PCT No.: PCT/KR2015/002808

§ 371 (c)(1),
(2) Date: Sep. 29, 2016

(87) PCT Pub. No.: WO2015/152548

PCT Pub. Date: Oct. 8, 2015

(65) Prior Publication Data

US 2017/0127486 A1 May 4, 2017

(30) Foreign Application Priority Data

Mar. 31, 2014 (KR) ..... 10-2014-0037885

(51) Int. Cl.
*H05B 33/08* (2006.01)

(52) U.S. Cl.
CPC ..... *H05B 33/0815* (2013.01); *H05B 33/083* (2013.01); *H05B 33/089* (2013.01); *H05B 33/0845* (2013.01)

(58) Field of Classification Search
CPC ..... H05B 33/083; H05B 33/0827; H05B 33/0845; H05B 33/0812; H05B 37/02;
(Continued)

(56) References Cited

U.S. PATENT DOCUMENTS 8,247,992 B2 * 8/2012 Liu ..... H05B 33/0818 315/169.1
8,457,095 B2 * 6/2013 Chou ..... H04L 12/2801 370/320

(Continued)

FOREIGN PATENT DOCUMENTS

JP 2009-004483 A 1/2009
JP 2013-073706 A 4/2013

*Primary Examiner* — Vibol Tan
(74) *Attorney, Agent, or Firm* — Birch, Stewart, Kolasch & Birch, LLP

(57) ABSTRACT

The light-emitting module according to one embodiment comprises first to Nth light-emitting element packages (wherein N is a positive integer greater than or equal to 1), which are connected in series to one another, and a current level regulator for regulating the level of current flowing through the Nth light-emitting element package. Each of the first to Nth light-emitting element packages comprises a light-emitting cell comprising a plurality of sub-cells, which comprise at least one light-emitting element and are connected in series or parallel to one another, and a flicker control unit, which is connected between the plurality of sub-cells and selectively forms the path of current flowing through the light-emitting cell according to the level of an external driving voltage. At least one of the first to Nth light-emitting element packages further comprises a first current control resistor connected to the output of the light-emitting cell.

20 Claims, 8 Drawing Sheets

LEGEND 130-1 first light emitting element package
130-2 second light emitting element package
134-1 ON/OFF controller
134-2 ON/OFF controller
140 current level regulator
142 current level controller
150 first surge protection unit
160 second surge protection unit
170 valley-fill circuit

(58) Field of Classification Search
CPC ..... H05B 33/0806; H05B 33/0821; H05B 33/0842; H05B 41/39; H05B 33/0815; H05B 33/0824; H05B 33/0809; H05B 33/0851; H05B 33/089; H05B 33/0887; H05B 37/036; Y02B 20/346; Y02B 20/347; G02F 1/133603; Y10S 362/80
See application file for complete search history.

(56) References Cited

U.S. PATENT DOCUMENTS

| | | | | |
|---|---|---|---|---|
| 8,531,128 | B2 * | 9/2013 | Weaver | H05B 33/0812 315/121 |
| 8,638,047 | B2 * | 1/2014 | Chiang | H02M 7/06 315/291 |
| 8,773,038 | B2 * | 7/2014 | Logiudice | H05B 33/083 315/291 |
| 9,000,674 | B2 * | 4/2015 | Lynch | H05B 33/0818 315/192 |
| 9,000,678 | B2 * | 4/2015 | Huynh | H05B 33/083 315/121 |
| 9,084,327 | B2 * | 7/2015 | Chiu | H05B 33/0851 |
| 9,246,403 | B2 * | 1/2016 | Siessegger | H05B 33/0803 |
| 9,320,098 | B2 * | 4/2016 | Yoo | H05B 33/0827 |
| 9,374,865 | B2 * | 6/2016 | Yamahara | H05B 33/0809 |
| 9,408,266 | B2 * | 8/2016 | Logiudice | |
| 9,622,309 | B2 * | 4/2017 | Kang | H05B 33/083 |
| 9,626,309 | B1 * | 4/2017 | Burke | G06F 13/1642 |
| 2008/0315778 | A1 | 12/2008 | Tatsukawa | |
| 2011/0140630 | A1 | 6/2011 | Doudousakis et al. | |
| 2012/0206047 | A1 | 8/2012 | Vos | |
| 2013/0293122 | A1 | 11/2013 | Huynh | |

* cited by examiner

【FIG. 1】
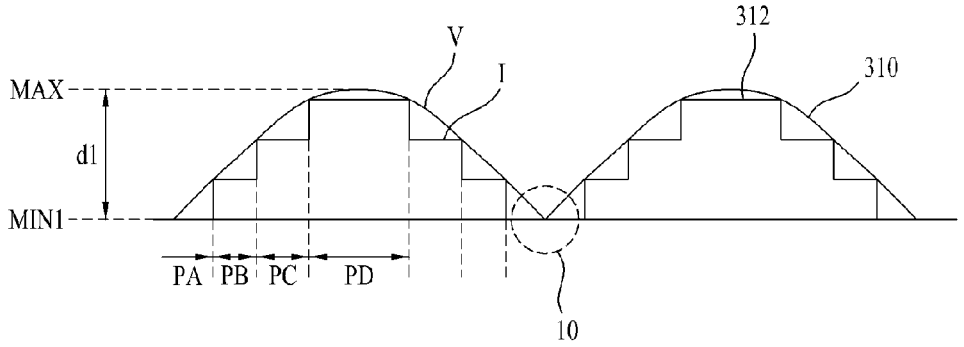
【FIG. 2】
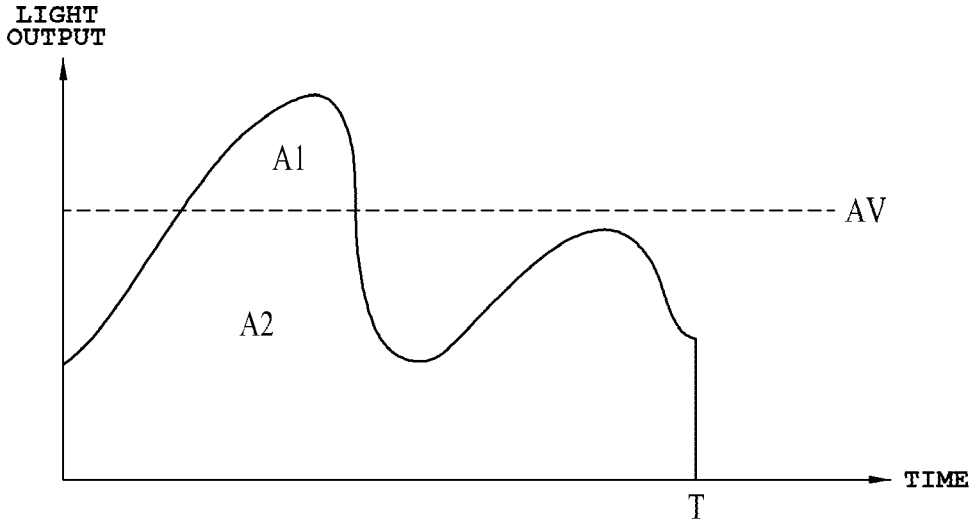

【FIG. 3】
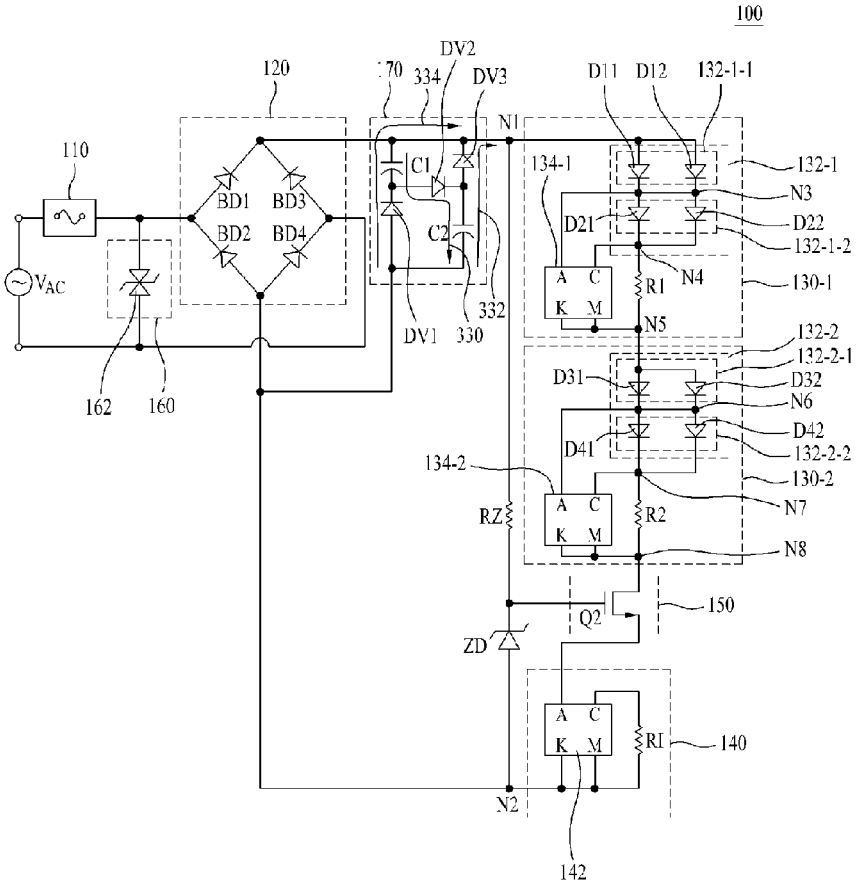
LEGEND
130-1 first light emitting element package
130-2 second light emitting element package
134-1 ON/OFF controller
134-2 ON/OFF controller
140 current level regulator
142 current level controller
150 first surge protection unit
160 second surge protection unit
170 valley-fill circuit 【FIG. 4】
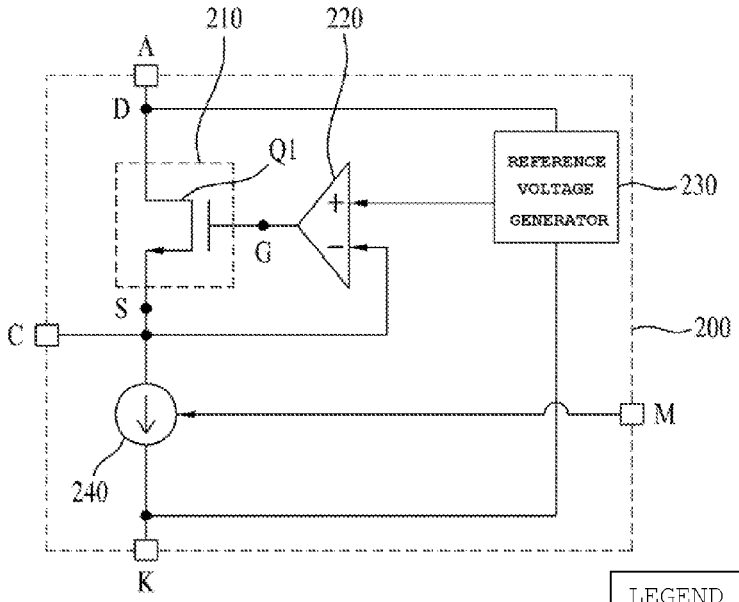
LEGEND
200 ON/OFF Controller
【FIG. 5a】
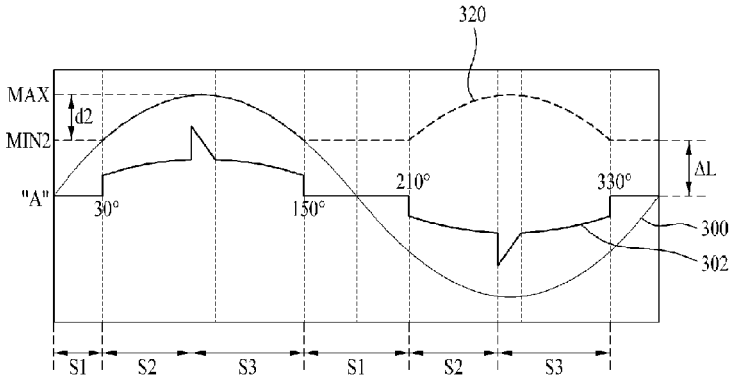

【FIG. 5b】
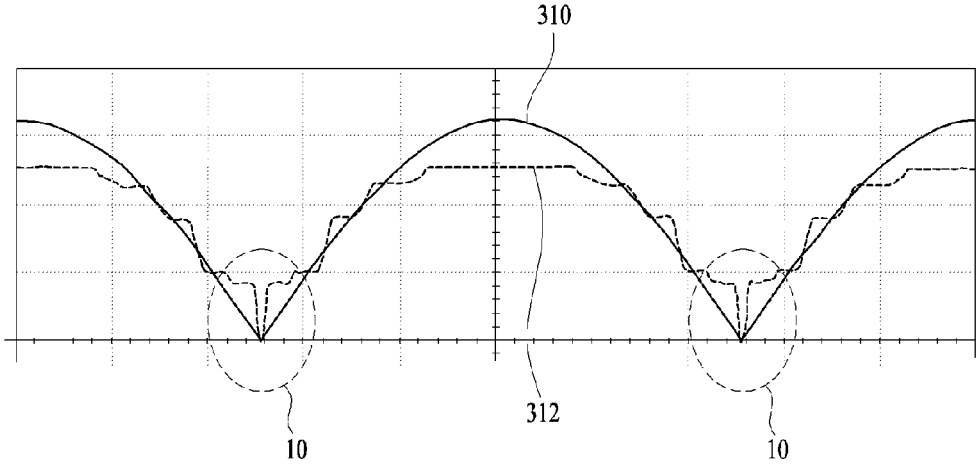
【FIG. 5c】
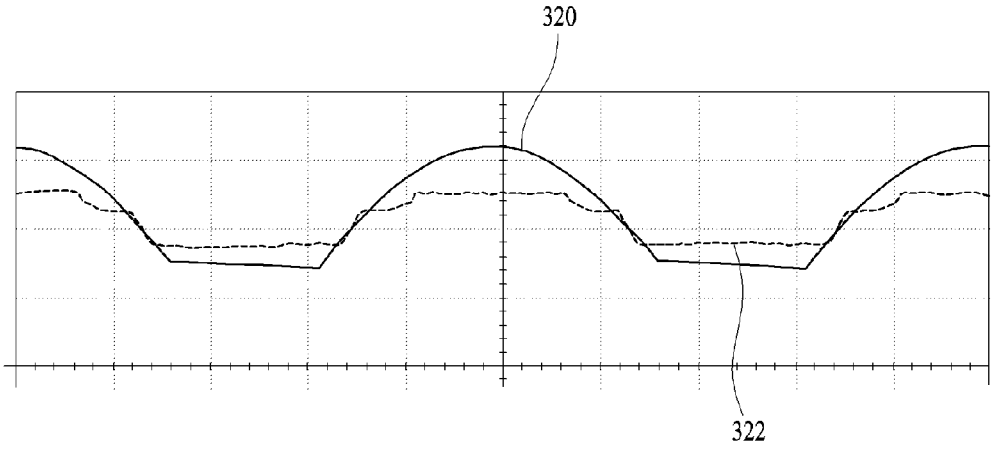

【FIG. 6】
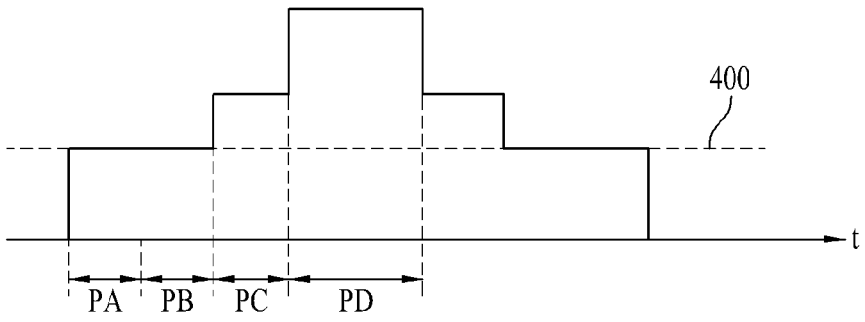
【FIG. 7】
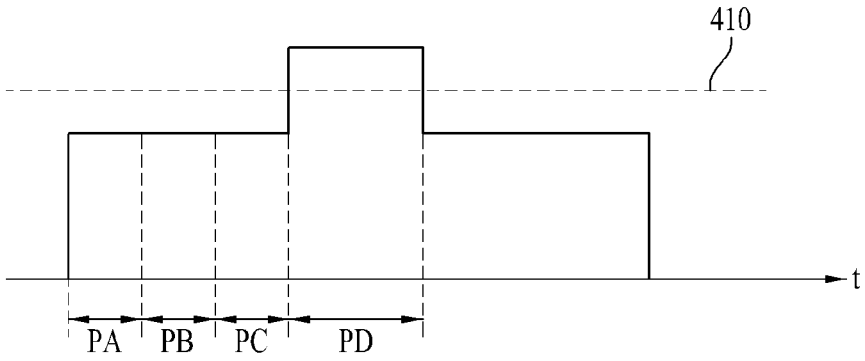

【FIG. 8a】
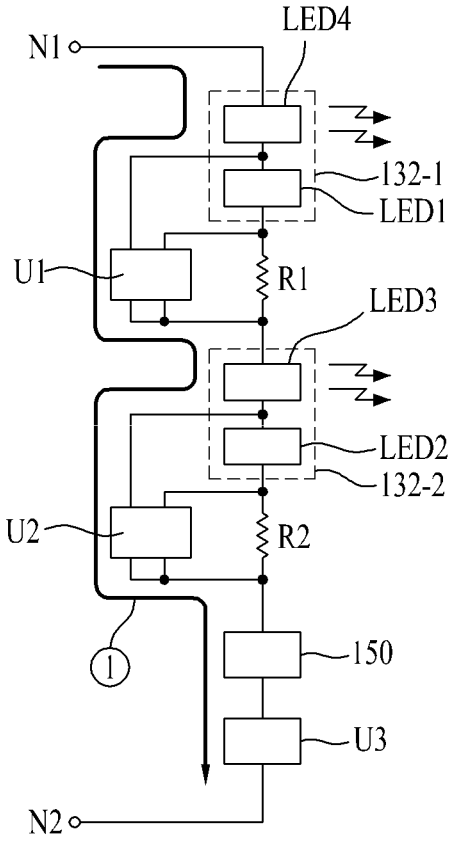

【FIG. 8b】
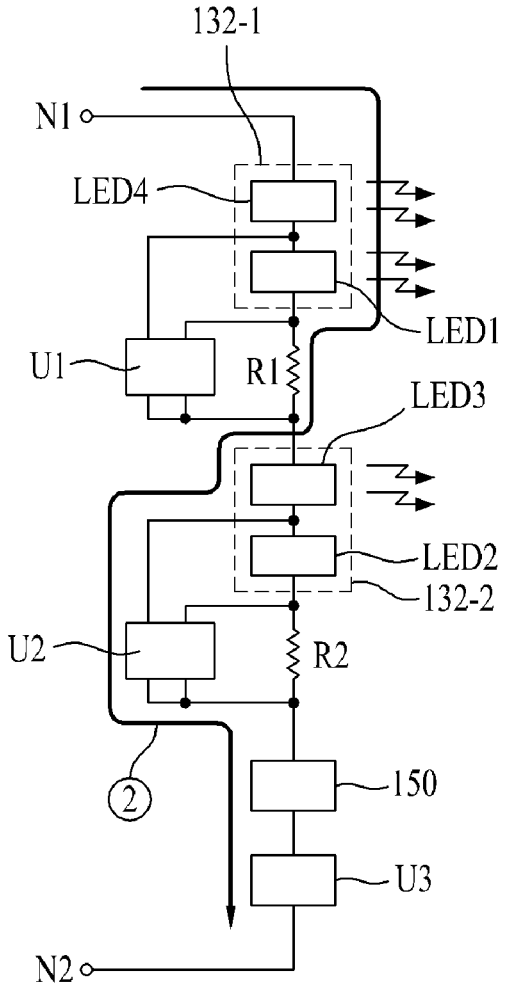

【FIG. 8c】
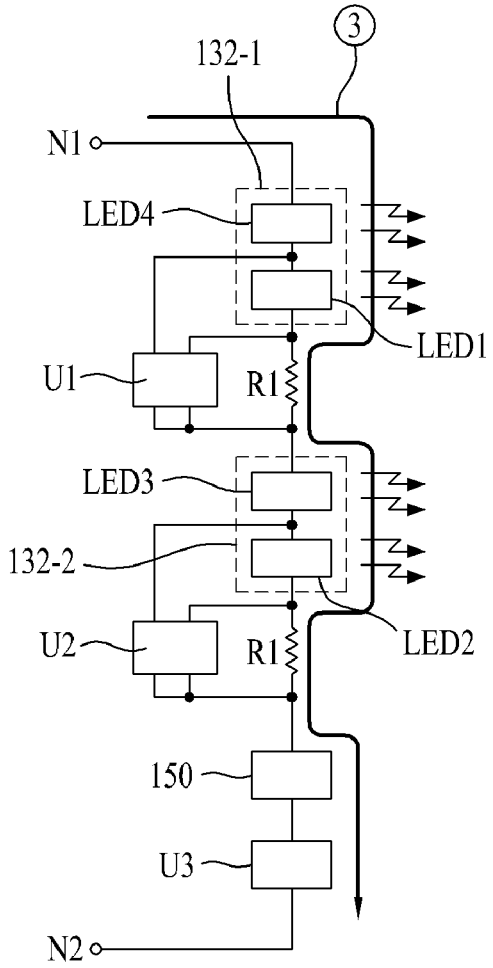

LIGHT-EMITTING MODULE

CROSS-REFERENCE TO RELATED APPLICATIONS

This application is the National Phase of PCT International Application No. PCT/KR2015/002808, filed on Mar. 23, 2015, which claims priority under 35 U.S.C. §119(a) to Patent Application No. 10-2014-0037885, filed in the Republic of Korea on Mar. 31, 2014, all of which are hereby expressly incorporated by reference into the present application.

TECHNICAL FIELD

Embodiments relate to a light emitting module.

BACKGROUND ART

A light emitting diode (LED) is a sort of a semiconductor device which converts electricity into infrared or visible light using characteristics of a compound semiconductor to exchange signals, and is used as a light source.

Group III-V nitride semiconductors have been spotlighted as a core material of a light emitting element, such as a light emitting diode (LED) or a laser diode (LD), due to physical and chemical characteristics thereof.

Since such light emitting diodes do not contain environmentally harmful materials such as mercury (Hg) used for existing lighting apparatuses, such as incandescent lamps or fluorescent lamps, and have long lifespan and low power consumption, the light emitting diodes are a replacement for existing light sources.

In general, a light emitting module includes a light emitting element package and the light emitting element package includes a light emitting element such as an LED.

FIG. 1 is a diagram showing the waveform of a ripple voltage obtained by full-wave rectifying an alternating current (AC) voltage in an existing light emitting module, wherein V denotes voltage and I denotes current.

In general, if an LED is used as a lighting apparatus, a plurality of LEDs is connected in series or in parallel and the LEDs are turned on or off by a driving integrated circuit (IC) of the light emitting module. The driving IC for controlling the plurality of LEDs generally rectifies an AC driving voltage and sequentially turns the plurality of LEDs on or off according to level change of the rectified ripple voltage V. At this time, by changing a time for applying the driving voltage and the level of the driving voltage, total harmonic distortion (THD) and power factor (PF) of the lighting apparatus may be determined. Referring to the waveform of FIG. 1, the LED is repeatedly turned on and off due to the characteristics of the ripple voltage V. That is, in the periods of the full-wave-rectified ripple voltage V, current I having a predetermined pattern is continuously supplied to turn the LED on in a period in which the ripple voltage V is equal to or greater than a predetermined voltage, and current I is not supplied to turn the LED off in a period in which the ripple voltage V is less than the predetermined value.

As described above, since the existing light emitting module controls ON or OFF of the LED with a very short period, flicker inevitably occurs. Although flicker is not easily visually recognized to the naked eye, when a person is exposed to flicker for a long period of time, the flicker may aggravate the person or cause the person to easily feel fatigued.

FIG. 2 is a graph illustrating a general flicker index, wherein a horizontal axis denotes a time and a vertical axis denotes light output.

A degree of flicker may be expressed by the flicker index. Referring to FIG. 2, the flicker index is expressed by Equation 1 below.

$$\frac{A1}{A1 + A2} \qquad \text{Equation 1}$$

where, referring to FIG. 2, A1 denotes an upper area of a portion having a value greater than an average light output AV and A2 denotes a lower area of a portion having a value less than the average light output AV. That is, the flicker index may be expressed by a ratio of the upper area to the total area. Such a flicker index has a value of "0" to "1".

Referring to FIGS. 1 and 2, as the level difference of current I increases, the flicker index increases and thus needs to be improved. In addition, the light emitting module needs to be designed with a high withstand voltage.

DISCLOSURE

Technical Problem

Embodiments provide a light emitting module having an improved flicker index and having a high withstand voltage.

Technical Solution

In one embodiment, a light emitting module may include first to N-th (where N being a positive integer equal to or greater than 1) light emitting element packages connected to each other in series, and a current level regulator for regulating a level of current flowing in the N-th light emitting element package. Each of the first to N-th light emitting element packages includes a light emitting cell, each of the light emitting cell including at least one light emitting element and including a plurality of sub cells connected to each other in series or in parallel and an ON/OFF controller connected between the plurality of sub cells and selectively forming a path, through which current flows, in the light emitting cell according to a level of an external driving voltage. At least one of the first to N-th light emitting element packages may further include a first current regulation resistor connected to an output of the light emitting cell. The ON/OFF controller may include a first reference voltage generator generating a first reference voltage using a voltage between a node between the sub cells and an output terminal of the ON/OFF controller. The ON/OFF controller may selectively form the path, through which current flows, in the light emitting cell by using the first reference voltage.

For example, the ON/OFF controller may further include a first current control integrated circuit (IC) for controlling current flowing in the light emitting cell.

For example, the light emitting module may further include a first surge protection unit disposed between the N-th light emitting element package and the current level regulator to protect the light emitting module from a surge voltage less than or equal to a predetermined voltage.

For example, the first surge protection unit may include a field effect transistor, the field effect transistor including a drain connected to the N-th light emitting element package, a gate for receiving the external driving voltage, and a source connected to the current level regulator.

For example, the light emitting module may further include a rectifier for rectifying the alternating current (AC) external driving voltage and supplying the rectified external driving voltage to the first to N-th light emitting element packages.

For example, the light emitting module may further include a second surge protection unit connected to the rectifier in parallel to protect the light emitting module from a surge voltage greater than the predetermined voltage.

For example, the second surge protection unit may include a varistor connected to the rectifier in parallel.

For example, the light emitting module may further include a fuse disposed between the AC external driving voltage and the rectifier.

For example, the light emitting module may further include a Zener resistor having one side connected to a first node between the rectifier and the first light emitting element package and a Zener diode having an anode connected to the other side of the Zener resistor and a cathode connected to the current level regulator.

For example, the plurality of sub cells may include a first sub cell having a plurality of light emitting elements connected to each other in parallel and a second sub cell connected to the first sub cell in series and having a plurality of light emitting elements connected to each other in parallel.

For example, the ON/OFF controller may further include a first switching element connected between a node between the plurality of sub cells and an output terminal of the light emitting cell to perform switching in response to a first switching control signal, a first comparator for comparing a voltage of the output terminal of the light emitting cell and a first reference voltage and outputting a comparison result as the first switching control signal, and a first current source connected between the output terminal of the light emitting cell and the output terminal of the ON/OFF controller.

For example, the ON/OFF controller may further include a first mode selector for controlling current of the first current source.

For example, the current level regulator may include a second current regulation resistor, a second switching element connected between the source and one side of the second current regulation resistor to perform switching in response to a second switching control signal, a second comparator for comparing a voltage of one side of the second current regulation resistor with a second reference voltage and outputting a comparison result as the second switching control signal, a second reference voltage generator for generating the second reference voltage using a voltage between the source and the other side of the second current regulation resistor, and a second current source connected between both sides of the second current regulation resistor.

For example, the light emitting module may further include a second mode selector for controlling current of the second current source.

For example, the light emitting module may further include a valley-fill circuit for reducing and outputting a level difference between a maximum value and a minimum value of the rectified external driving voltage. The valley-fill circuit may include a first diode having an anode connected to a low potential of the rectified external driving voltage, a first capacitor connected between a high potential of the rectified external driving voltage and a cathode of the first diode, a second diode having an anode connected to the cathode of the first diode, a third diode having an anode and a cathode respectively connected to the cathode of the second diode and the high potential of the rectified external driving voltage, and a second capacitor connected between the cathode of the second diode and the low potential of the rectified external driving voltage.

For example, the light emitting module may further include a first surge protection circuit disposed between the valley-fill circuit and the first light emitting element package to protect the light emitting module from a surge voltage equal to or less than a predetermined voltage.

For example, the light emitting module may further include a first surge protection circuit disposed between the first light emitting element package and the second light emitting element package to protect the light emitting module from a surge voltage equal to or less than a predetermined voltage.

For example, the level difference may be reduced by a predetermined level and the predetermined level may be 40% to 50% of the level difference.

In another embodiment, a light emitting module may include first to N-th (where N being a positive integer equal to or greater than 1) light emitting element packages electrically connected to each other, a rectifier rectifying an alternating current (AC) external driving voltage, and a valley-fill circuit reducing a difference between a maximum value and a minimum value of the external driving voltage rectified by the rectifier, and outputting the external driving voltage having the reduced level to the first to N-th light emitting element packages. Each of the first to N-th light emitting element packages may include a light emitting cell, each of the light emitting cell including at least one light emitting element and including a plurality of sub cells connected to each other in series or in parallel and an ON/OFF controller connected between the plurality of sub cells and selectively forming a path in which current flows in the light emitting cell according to the reduced level of the external driving voltage. The ON/OFF controller may include a first reference voltage generator generating a first reference voltage using a voltage between a node between the sub cells and an output terminal of the ON/OFF controller. The ON/OFF controller may selectively form the path, through which current flows, in the light emitting cell by using the first reference voltage.

Advantageous Effects

A light emitting module according to an embodiment can reduce a difference between a maximum value and a minimum value of driving current using a valley-fill circuit to improve flicker, further reduce a flicker index using first and second current regulation resistors and be protected from a high surge voltage using a first surge protection unit.

DESCRIPTION OF DRAWINGS

FIG. 1 is a diagram showing the waveform of a ripple voltage obtained by full-wave rectifying an alternating current (AC) voltage in an existing light emitting module.

FIG. 2 is a graph illustrating a general flicker index.

FIG. 3 is a circuit diagram showing a light emitting module according to an embodiment.

FIG. 4 is a circuit diagram showing an embodiment of ON/OFF controllers shown in FIG. 3.

FIGS. 5*a* to 5*c* are diagrams showing the waveforms of the driving signals for driving first to N-th light emitting element packages when the light emitting module shown in FIG. 3 includes or does not include a valley-fill circuit shown in FIG. 3.

FIG. 6 is a diagram showing the waveform of current for driving the first to N-th light emitting element packages when the light emitting module shown in FIG. 3 does not include first and second current regulation resistors.

FIG. 7 is a diagram showing the waveform of driving current for driving the first to N-th light emitting element packages when the light emitting module shown in FIG. 3 includes first and second current regulation resistors.

FIGS. 8*a* to 8*c* are diagrams showing a state in which sub cells are turned on and off when the driving current is applied in the form shown in FIGS. 6 and 7.

BEST MODE

Hereinafter, exemplary embodiments will be described in detail with reference to the accompanying drawings. The embodiments may be modified in various ways. However, this is not intended to limit the disclosure to the specific embodiments. Embodiments are provided for full understanding of the disclosure.

In addition, the relative terms "first" and "second", "top/upper/above", "bottom/lower/under" and the like in the description and in the claims may be used to distinguish between any one substance or element and other substances or elements and not necessarily for describing any physical or logical relationship between the substances or elements or a particular order.

FIG. 3 is a circuit diagram showing a light emitting module 100 according to an embodiment.

Referring to FIG. 3, the light emitting module 100 includes a fuse 110, a rectifier 120, first to N-th light emitting element packages 130-1 to 130-N, a current level regulator 140, first and second surge protection units 150 and 160, and a valley-fill circuit 170. Here, N may be a positive integer equal to or greater than 1. Hereinafter, in order to aid in understanding of the embodiment, although it is assumed that N=2, the embodiments are not limited thereto. That is, even when N is greater or less than 2, the following description is applicable.

First, the first and second light emitting element packages 130-1 and 130-2 are connected in series. The first light emitting element package 130-1 includes a light emitting cell 132-1 and an ON/OFF controller 134-1 and the second light emitting element package 130-2 includes a light emitting cell 132-2 and an ON/OFF controller 134-2.

The light emitting cell 132-1 included in the first light emitting element package 130-1 may include a plurality of sub cells 132-1-1 and 132-1-2. As shown in FIG. 3, although the plurality of sub cells 132-1-1 and 132-1-2 may be connected in series, the embodiments are not limited thereto. That is, according to another embodiment, the plurality of sub cells 132-1-1 and 132-1-2 may be connected to each other in parallel. Each of the plurality of sub cells 132-1-1 and 132-1-2 may include at least one light emitting element. For example, among the plurality of sub cells, the first sub cell 132-1-1 may include two light emitting elements D11 and D12 connected in parallel and the second sub cell 132-1-2 may include two light emitting elements D21 and D22 connected in parallel. According to another embodiment, unlike FIG. 3, the light emitting elements D11 and D12 or D21 and D22 included in the first and second sub cells 132-1-1 and 132-1-2 may be connected to each other in series.

Similarly to the first light emitting element package 130-1, the light emitting cell 132-2 included in the second light emitting element package 130-2 may include a plurality of sub cells 132-2-1 and 132-2-2. As shown in FIG. 3, the plurality of sub cells 132-2-1 and 132-2-2 may be connected to each other in series, without being limited thereto. That is, according to another embodiment, the plurality of sub cells 132-2-1 and 132-2-2 may be connected to each other in parallel. Each of the plurality of sub cells 132-2-1 and 132-2-2 may include at least one light emitting element. For example, among the plurality of sub cells, the first sub cell 132-2-1 may include two light emitting elements D31 and D32 connected in parallel and the second sub cell 132-2-2 may include two light emitting elements D41 and D42 connected in parallel. According to another embodiment, unlike FIG. 3, the light emitting elements D31 and D32 or D41 and D42 included in the first and second sub cells 132-2-1 and 132-2-2 may be connected to each other in series.

Each of the light emitting elements D11, D12, D21, D22, D31, D32, D41, and D42 may be a light emitting diode (LED), for example. The light emitting diode may include color light emitting diodes for emitting colored light such as red, green, blue, or white light and an ultraviolet (UV) light emitting diode for emitting UV light. However, the embodiments are not limited to the kind of the light emitting diodes D11, D12, D21, D22, D31, D32, D41, and D42.

In addition, the ON/OFF controller 134-1 included in the first light emitting element package 130-1 is connected between the plurality of sub cells 132-1-1 and 132-1-2 to selectively form a path, through which current flows, in the light emitting cell 132-1 according to the level of an external driving voltage $V_{AC}$. Similarly, the ON/OFF controller 134-2 included in the second light emitting element package 130-2 is connected between the plurality of sub cells 132-2-1 and 132-2-2 to selectively form a path, through which current flows, in the light emitting cell 132-2 according to the level of an external driving voltage $V_{AC}$.

Each of the ON/OFF controllers 134-1 and 134-2 may include a first current control integrated circuit (IC) for controlling current flowing in the light emitting cells 132-1 and 132-2.

FIG. 4 is a circuit diagram showing an embodiment 200 of each of the ON/OFF controllers 134-1 and 134-2 shown in FIG. 3.

Referring to FIG. 4, the ON/OFF controller 200 includes a switching element 210, a comparator 220, a reference voltage generator 230, and a current source 240. Here, if the ON/OFF controller 200 is implemented in the form of an IC, a plurality of pins C, A, K, and M may be included. Here, current may be sensed through the pin C, current may be received through the pin A, current may be output through the pin K, and the level of current flowing in the current source 240 may be adjusted through the pin M.

If the ON/OFF controller 200 shown in FIG. 4 corresponds to the ON/OFF controller 134-1 of the first light emitting element package 130-1 shown in FIG. 3, the switching element 210 is connected between a node N3 between the sub cells 132-1-1 and 132-1-2 and the output terminal N4 of the light emitting cell 132-1 to perform switching in response to a switching control signal. In this case, the pin A is connected to the node N3 between the sub cells 132-1-1 and 132-1-2 and the pin C is connected to the output terminal N4.

For example, although the switching element 210 is implemented as a field effect transistor (FET) Q1 as shown in FIG. 4, embodiments are not limited thereto. According to another embodiment, the switching element 210 may be implemented as a bipolar transistor.

The drain D of the field effect transistor Q1 is connected to the node N3 (that is, the pin A) between the sub cells 132-1-1 and 132-1-2, the gate thereof receives the switching control signal, and the source S thereof is connected to the output terminal N4 (that is, the pin C) of the light emitting cell 132-1.

The comparator 220 compares the voltage of the output terminal N4 (that is, the pin C) of the light emitting cell 132-1 with a reference voltage and outputs the comparison result to the switching element 210 as the switching control signal.

The reference voltage generator 230 generates a reference voltage using a voltage between the node N3 (that is, the pin A) between the sub cells 132-1-1 and 132-1-2 and the output terminal N5 (that is, the pin K) of the ON/OFF controller 200 and outputs the generated reference voltage to the comparator 220.

The current source 240 is connected between the output terminal N4 (that is, the pin C) of the light emitting cell 132-1 and the output terminal N5 (that is, the pin K) of the ON/OFF controller 200. At this time, the ON/OFF controller 200 may further include at least one mode selector M. The mode selector M is responsible for changing the level of current flowing in the current source 240.

If the ON/OFF controller 200 shown in FIG. 4 corresponds to the ON/OFF controller 134-2 of the second light emitting element package 130-2 shown in FIG. 3, the switching element 210 is connected between a node N6 (that is, the pin A) between the sub cells 132-2-1 and 132-2-2 and an output terminal N7 (that is, the pin C) of the light emitting cell 132-2 to perform switching in response to a switching control signal. For example, although the switching element 210 is implemented as a field effect transistor (FET) Q1 as shown in FIG. 4, embodiments are not limited thereto. According to another embodiment, the switching element 210 may be implemented as a bipolar transistor.

The drain of the field effect transistor Q1 is connected to the node N6 (that is, the pin A) between the sub cells 132-2-1 and 132-2-2, the gate thereof receives the switching control signal, and the source thereof is connected to the output terminal N7 (that is, the pin C) of the light emitting cell 132-2.

The comparator 220 compares the voltage of the output terminal N7 (that is, the pin C) of the light emitting cell 132-2 with a reference voltage, and outputs the comparison result to the switching element 210 as the switching control signal.

The reference voltage generator 230 generates a reference voltage using a voltage between the node N6 (that is, the pin A) between the sub cells 132-2-1 and 132-2-2 and an output terminal N8 (that is, the pin K) of the ON/OFF controller 200, and outputs the generated reference voltage to the comparator 220.

The current source 240 is connected between the output terminal N7 (that is, the pin C) of the light emitting cell 132-2 and the output terminal N8 (that is, the pin K) of the ON/OFF controller 200. At this time, the ON/OFF controller 200 may further include at least one mode selector M. The mode selector M is responsible for changing the level of current flowing in the current source 240.

At least one of the first to N-th light emitting element packages may further include a first current regulation resistor connected to the output of the light emitting cell. In FIG. 3, in the case of N=2, although each of the first and second light emitting element packages 130-1 and 130-2 includes the first current regulation resistors R1 and R2, embodiments are not limited thereto. That is, according to another embodiment, only one of the first and second light emitting element packages 130-1 and 130-2 may include the first current regulation resistors R1 and R2.

Referring to FIG. 3 again, the first surge protection unit 150 is provided between the N-th light emitting element package (in the case of N=2, 130-2) and the current level regulator 140 to protect the elements included in the light emitting module 100 from a surge voltage (or a withstand voltage) having a predetermined voltage or less. To this end, the first surge protection unit 150 may be implemented as a field effect transistor Q2. That is, the field effect transistor Q2 includes a drain connected to the N-th light emitting element package 130-2, a gate for receiving an external driving voltage, and a source connected to the current level regulator 140. For example, although the predetermined voltage may be 300 to 800 volts, embodiments are not limited to a predetermined voltage level.

According to another embodiment, the first surge protection unit 150 may be disposed in a form different from that shown in FIG. 3. For example, unlike FIG. 3, the first surge protection unit 150 may be disposed between the valley-fill circuit 170 and the first light emitting element package 130-1 or between the first light emitting element package 130-1 and the second light emitting element package 130-2.

In addition, the current level regulator 140 is responsible for adjusting the level of current flowing in the second light emitting element package 130-2 (in the case of N=2) corresponding to the N-th light emitting element package. For example, the current level regulator 140 includes a second current regulation resistor RI and a current level controller 142. The current level controller 142 may include a switching element, a comparator, a reference voltage generator, and a current source. The switching element, the comparator, the reference voltage generator, and the current source of the current level controller 142 respectively correspond to the switching element 210, the comparator 220, the reference voltage generator 230, and the current source 240 shown in FIG. 4 and have the same configuration and perform the same operation. Accordingly, the current level regulator 140 may be implemented in the form of an IC and may include pins A, C, K, and M.

In this case, referring to FIG. 4, the switching element 210 is connected between the source of the first surge protection unit 150 and one side of the second current regulation resistor RI and performs switching in response to the switching control signal. The pin A is connected to the source of the first surge protection unit 150 and the pin C is connected to one side of the second current regulation resistor RI.

For example, although the switching element 210 may be implemented as the field effect transistor Q1 as shown in FIG. 4, embodiments are not limited thereto. According to another embodiment, the switching element 210 may be implemented as a bipolar transistor.

The drain of the field effect transistor Q1 is connected to the source (that is, the pin A) of the first surge protection unit 150, the gate thereof receives the switching control signal, and the source of Q1 is connected to one side (that is, the pin C) of the second current regulation resistor RI.

The comparator 220 compares the voltage of one side (that is, the pin C) of the second current regulation resistor RI with the reference voltage, and outputs the comparison result to the switching element 210 as the switching control signal.

The reference voltage generator 230 generates the reference voltage using a voltage between the source (that is, the pin A) of the first surge protection unit 150 and the other side (that is, the pin K) of the second current regulation resistor RI, and outputs the generated reference voltage to the comparator 220.

The current source 240 is connected between both sides of the second current regulation resistor RI.

At this time, the current level controller 142 may further include at least one mode selector M as shown in FIG. 4. The mode selector M is responsible for controlling the current of the current source 240.

Meanwhile, the fuse 110 is disposed between the AC external driving voltage $V_{AC}$ and the rectifier 120 to protect the elements included in the light emitting module 100 from current having an instantaneously high level.

In addition, the rectifier 120 rectifies the AC external driving voltage $V_{AC}$ and supplies the rectified external driving voltage to the first to N-th light emitting element packages 130-1 and 130-2 and the current level regulator 140. To this end, the rectifier 120 may include bridge diodes BD1, BD2, BD3, and BD4. For example, the rectifier 120 may full-wave rectify the AC external driving voltage.

The second surge protection unit 160 is connected to the rectifier 120 in parallel to protect the elements included in the light emitting module 100 from a surge voltage greater than the predetermined voltage. To this end, the second surge protection unit 160 may include a varistor (or a metal oxide varistor) 162 connected to the rectifier 120 in parallel.

For example, if the predetermined voltage is 800 volts, the first surge protection unit 150 is responsible for protecting the elements included in the light emitting module 100 from a surge voltage equal to or less than 800 volts and the second surge protection unit 160 is responsible for protecting the elements included in the light emitting module 100 from a surge voltage greater than 800 volts. When the light emitting module 100 is protected by the first surge protection unit 150 from the surge voltage equal to or less than 800 volts, the light emitting module 100 may be protected by the second surge protection unit 160 from the surge voltage greater than 800 volts. That is, the light emitting module 100 may be protected from the surge voltage equal to or greater than 1000 volts.

A Zener resistor RZ has one side connected to a node N1 between the rectifier 120 and the first light emitting element package 130-1 and the other side connected to the anode of a Zener diode ZD.

The Zener diode ZD has an anode connected to the other side of the Zener resistor RZ and a cathode connected to the other side N2 of the second current regulation resistor RI in the current level regulator 140.

Meanwhile, the valley-fill circuit 170 may reduce the level difference between the maximum level and the minimum level of the external driving voltage rectified by the rectifier 120, and output the reduced level difference.

The valley-fill circuit 170 shown in FIG. 3 may include first to third diodes DV1 to DV3 and first and second capacitors C1 and C2.

The first diode DV1 has an anode connected to a low potential of the rectified external driving voltage and a cathode connected to the first capacitor C1.

The first capacitor C1 is connected between a high potential of the rectified external driving voltage and the cathode of the first diode DV1.

The second diode DV2 has an anode connected to the cathode of the first diode DV1 and a cathode connected to the anode of the third diode DV3.

The third diode DV3 has an anode connected to the cathode of the second diode DV2 and a cathode connected to the high potential of the rectified external driving voltage.

The second capacitor C2 is connected between the cathode of the second diode DV2 and the low potential of the rectified external driving voltage.

Hereinafter, operation of the light emitting module 100 according to the embodiment having the above-described configuration will be described with reference to the accompanying drawings.

FIGS. 5*a* to 5*c* are diagrams showing the waveforms of the driving signals (that is, driving voltage and driving current) for driving first to N-th light emitting element packages 130-1 and 130-2 when the light emitting module 100 shown in FIG. 3 includes or does not include the valley-fill circuit 170 shown in FIG. 3.

Referring to FIG. 5*a*, the AC external driving voltage 300 is applied to the light emitting module 100 shown in FIG. 3. At this time, the external driving current 302 is changed according to the level of the external driving voltage 300.

Thereafter, referring to FIG. 5*b*, the external driving voltage 300 shown in FIG. 5*a* is rectified by the rectifier 120 and the rectified external driving voltage 310 and the external driving current 312 are output to the valley-fill circuit 170.

Thereafter, referring to FIGS. 3 and 5*c*, in the valley-fill circuit 170, the first and second capacitors C1 and C2 are charged with the rectified external driving voltage through a charging path 330 up to an approximately middle level of the rectified external driving voltage received from the rectifier 120 (a period "S2" of FIG. 5*a*). When the level of the rectified external driving voltage falls to a valley phase below a peak value, the voltage level of the node N1 approximately falls to a half the rectified external driving voltage. At this time, referring to FIGS. 5*a* and 5*c*, the voltage 320, with which the first and second capacitors C1 and C2 are charged, is output to the node N1 through discharge paths 332 and 334 (periods "S1" and "S3" of FIG. 5*a*). As shown in FIG. 5*a*, the periods "S1" to "S3" are repeated.

Referring to FIGS. 1 and 5*a*, the valley-fill circuit 170 reduces the level difference d1 between the maximum level MAX and the minimum level MINI of the rectified external driving voltage 310 by a predetermined level ΔL, and outputs the reduced level difference to the node N1. Accordingly, the level difference d2 between the maximum level MAX and the minimum level MIN2 of the signal output from the valley-full circuit 170 becomes less than the level difference d1 as shown in Equation 2 below and thus flicker can be improved.

$$d2=d1-\Delta L \qquad \text{Equation 2}$$

For example, the predetermined level ΔL may be 40% to 50% of the total level d1.

FIG. 6 is a diagram showing the waveform of current for driving the first to N-th light emitting element packages, when the light emitting module 100 shown in FIG. 3 does not include first and second current regulation resistors R1, R2, and RI.

Referring to FIGS. 1 and 5*b*, when ON and OFF of the sub cells 132-1-1, 132-1-2, 132-2-1, and 132-2-2 included in the light emitting element packages 130-1 and 130-2 are controlled in correspondence with the level change of the rectified external driving current 312, flicker occurs in the period 10 (PA).

In contrast, referring to FIGS. 5*c* and 6, the level of the period PA increases to be equal or similar to the level of the period PB using the valley-fill circuit 170. Therefore, the average 400 of current for driving the first to N-th light emitting element packages 130-1 and 130-2 increases as compared to FIG. 1. That is, flicker can be improved by removing the OFF period PA of the sub cells 132-1-1, 132-1-2, 132-2-1, and 132-2-2.

Hereinafter, prior to the detailed description of the ON and OFF of the sub cells 132-1-1, 132-1-2, 132-2-1, and 132-2-2, operation of the circuit 200 shown in FIG. 4 corresponding to the embodiment of the ON/OFF controllers 134-1 and 134-2 and the current level controller 142 will be described.

Using the voltage between the pin A and the pin K, the reference voltage generator 230 generates and outputs the reference voltage to the comparator 220. The comparator 220 outputs a switching control signal having a "high" logic level when the level of the reference voltage applied to the positive input terminal (+) is greater than the voltage dropped to the pin C. However, the comparator 220 outputs a switching control signal of a "low" logic level when the voltage dropped to the pin C applied to the negative input terminal (−) is greater than the reference voltage applied to the positive input terminal (+).

At this time, the FET Q1 corresponding to the switching element 210 is turned on in response to the switching control signal of the "high" logic level and is turned off in response to the switching control signal of the "low" logic level.

If the switching element 210 is turned off, the circuit 200 blocks a current path at a corresponding position in the light emitting module 100 shown in FIG. 3 such that current flows through the sub cells 132-1-1 and 132-1-2 or 132-2-1 and 132-2-2. If the switching element 210 is turned on, the circuit 200 forms a current path at a corresponding position such that current does not flow through the sub cells 132-1-2 or 132-2-2.

For example, in the case where the circuit 200 corresponds to the ON/OFF controller 134-1 shown in FIG. 3, if the circuit 200 is turned off, driving current applied through the node N1 flows to the node N5 through the sub cells 132-1-1 and 132-1-2. However, when the circuit 200 is turned on, the driving current applied through the node N1 flows to the node N5 through the sub cell 132-1-1 and the circuit 200. In this case, since the circuit 200 is turned on, current does not flow to the sub cell 132-1-2. If the circuit 200 corresponds to the ON/OFF controller 134-2 or the current level controller 142 shown in FIG. 3, the circuit 200 similarly operates.

FIG. 7 is a diagram showing the waveform of driving current for driving the first to N-th light emitting element packages 130-1 and 130-2, when the light emitting module 100 shown in FIG. 3 includes first and second current regulation resistors R1, R2, and RI.

In the light emitting module 100 shown in FIG. 3, the light emitting element packages 130-1 and 130-2 respectively include the first current regulation resistors R1 and R2 and the current level regulator 140 includes the second current regulation resistor RI.

If the values of the first current regulation resistors R1 and R2 are reduced, the level of the driving current in the periods PA and PB shown in FIG. 6 increases to the level of the period PC or increases to approximate to the level of the period PC as shown in FIG. 7. In addition, if the value of the second current regulation resistor RI increases, the level of the driving current of the period PD shown in FIG. 6 decreases as shown in FIG. 7. Therefore, the average 410 of the current for driving the first to N-th light emitting element packages 130-1 and 130-2 increases as compared to FIG. 6 and thus the flicker index may further decrease.

Hereinafter, based on the above-described operation of the fuse 110, the rectifier 120, the valley-fill circuit 170, and the circuits 134-1, 134-2, and 142, ON and OFF of the sub cells 132-1-1, 132-1-2, 132-2-1, and 132-2-2 in the light emitting module 100 shown in FIG. 3 will now be described.

FIGS. 8*a* to 8*c* are diagrams showing a state in which sub cells 132-1-1, 132-1-2, 132-2-1, and 132-2-2 are turned on and off when the driving current is applied in the form shown in FIGS. 6 and 7.

For convenience of description, in FIGS. 8*a* to 8*c*, the sub cells 132-1-1, 132-1-2, 132-2-1, and 132-2-2 are respectively referred to as "LED4", "LED1", "LED3," and "LED2", the first and second ON/OFF controllers 134-1 and 134-2 are respectively referred to as "U1" and "U2", and the current level controller 142 is referred to as "U3".

First, operation of the light emitting module 100 shown in FIG. 3 when the driving current applied to the node N1 has the shape shown in FIG. 6 will now be described.

In the periods PA and PB, the light emitting module 100 operates as shown in FIG. 8*a*. That is, referring to FIG. 8*a*, in the periods PA and PB, U1 to U3 are turned on to form a path, through which current flows, in a direction ① of an arrow. Accordingly, LED4 and LED3 are turned on and LED1 and LED2 are turned off.

In addition, in the period PC, the light emitting module 100 operates as shown in FIG. 8*b*. That is, referring to FIG. 8*b*, in the period PC, U1 is turned off and U2 and U3 are turn on to form a path, through which current flows, in a direction ② of an arrow. Accordingly, LED4, LED1, and LED3 are turned on and only LED2 is turned off.

In addition, in the period PD, the light emitting module 100 operates as shown in FIG. 8*c*. That is, referring to FIG. 8*c*, in the period PD, U1 and U2 are turned off and only U3 is turned on to form a path, through which current flows, in a direction ③ of an arrow. Accordingly, LED1, LED2, LED3, and LED4 are all turned on.

Next, operation of the light emitting module 100 shown in FIG. 3 when the driving current applied to the node N1 has the shape shown in FIG. 7 will now be described.

In the periods PA, PB, and PC, the light emitting module 100 operates as shown in FIG. 8*b*. That is, referring to FIG. 8*b*, in the periods PA, PB, and PC, U1 is turned off and U2 and U3 are turned on to form a path, through which current flows, in a direction ② of an arrow. Accordingly, LED4, LED1, and LED3 are turned on and only LED2 is turned off.

In addition, in the period PD, the light emitting module 100 operates as shown in FIG. 8*c*. That is, referring to FIG. 8*c*, in the period PD, U1 and U2 are turned off and only U3 is turn on to form a path, through which current flows, in a direction ③ of an arrow. Accordingly, LED1, LED2, LED3, and LED4 are all turned on. At this time, if the resistance value of the second current regulation resistor RI is high, the current level of the period PD may decrease from FIG. 6 as shown in FIG. 7.

Operations of LED1 to LED4 and operations of U1 to U3 in each of the periods PA, PB, PC and PD shown in FIGS. 6 and 7 are shown in Table 1 below.

TABLE 1

| Classification | PA and PB of FIG. 7 | PC of FIG. 7 | PD of FIG. 7 | PA, PB, and PC of FIG. 8 | PD of FIG. 8 |
|---|---|---|---|---|---|
| LED 1 | X | ○ | ○ | ○ | ○ |

TABLE 1-continued

| Classification | PA and PB of FIG. 7 | PC of FIG. 7 | PD of FIG. 7 | PA, PB, and PC of FIG. 8 | PD of FIG. 8 |
|---|---|---|---|---|---|
| LED 2 | X | X | ○ | X | ○ |
| LED 3 | ○ | ○ | ○ | ○ | ○ |
| LED 4 | ○ | ○ | ○ | ○ | ○ |
| U1 | ○ | X | X | X | X |
| U2 | ○ | ○ | X | ○ | X |
| U3 | ○ | ○ | ○ | ○ | ○ |

where, "○" denotes ON and "X" denotes OFF.

Meanwhile, if the value of current flowing in the circuit 200 shown in FIG. 4 for implementing the first and second ON/OFF controllers 134-1 and 134-2 and the current level controller 142 are differently set, the current value may be adjusted according to the periods PA, PB, PC, and PD and thus a difference between the maximum value MAX and the minimum value MIN2 of the current value decreases, thereby improving flicker.

In addition, if the driving signal shown in FIG. 5*b* is used, the THD of the light emitting module 100 is 11%, a PF is 99%, and a ripple factor is 100%. In contrast, if the light emitting module 100 includes the valley-fill circuit 170, that is, if the driving signal shown in FIG. 5*c* is used, the THD of the light emitting module 100 is 22%, the PF is 96% and the ripple factor is 34.2%. Accordingly, it can be seen that, if the valley-fill circuit 170 is used, the ripple factor decreases to 40% or less. At this time, if the level of the OFF period PA shown in FIG. 1 increases as shown in FIGS. 5*b* and 6, the flicker index shown in Equation 1 may decrease.

Further, according to the embodiment, the resistance values of the first current regulation resistors R1 and R2 decrease such that the current levels of the periods PA and PB shown in FIG. 6 increase to the current level of the period PC as shown in FIG. 7 or increase to approximate to the current level of the period PC shown in FIG. 7. In addition, the resistance value of the second current regulation resistor RI increases such that the current level of the period PD shown in FIG. 6 decreases as shown in FIG. 7. In this case, the average 400 of the driving current shown in FIG. 6 increases to the average 410 shown in FIG. 7. Accordingly, as shown in Equation 1 above, the flicker index may further decrease.

As described above, if the resistance values of the first and second current regulation resistors R1, R2 and RI are regulated using the valley-fill circuit 170 to improve the flicker index, the THD becomes 25% and the PF may be 95%.

In addition, since the light emitting module 100 according to the embodiment includes the first surge protection unit 150, it is possible to protect the light emitting module from a high surge voltage.

Although the preferred embodiments have been disclosed, the embodiments are purely exemplary and do not limit the present disclosure. Those skilled in the art will appreciate that various modifications and applications are possible, without departing from the embodiments. For example, the components described in the embodiments may be modified and embodied. Further, differences related to such modifications and applications should be interpreted as being within the scope of the present disclosure defined by the accompanying claims.

MODE FOR INVENTION

Various embodiments have been described in the best mode for carrying out the disclosure.

INDUSTRIAL APPLICABILITY

The light emitting modules according to embodiments are applicable to a display apparatus, a pointing apparatus, and a lighting apparatus, etc. The lighting apparatus may include a lamp, a headlamp, or a streetlamp, for example.

The invention claimed is:

1. A light emitting module, comprising:

first to N-th (where N being a positive integer equal to or greater than 1) light emitting element packages connected to each other in series; and a current level regulator regulating a level of current flowing in the N-th light emitting element package, wherein each of the first to N-th light emitting element packages includes:

a light emitting cell, each of the light emitting cell including at least one light emitting element and including a plurality of sub cells connected to each other in series or in parallel; and an ON/OFF controller connected between the plurality of sub cells and selectively forming a path, through which current flows, in the light emitting cell according to a level of an external driving voltage, wherein at least one of the first to N-th light emitting element packages further includes a first current regulation resistor connected to an output of the light emitting cell, wherein the ON/OFF controller comprises a first reference voltage generator generating a first reference voltage using a voltage between a node between the sub cells and an output terminal of the ON/OFF controller, and wherein the ON/OFF controller selectively forms the path, through which current flows, in the light emitting cell by using the first reference voltage.

2. The light emitting module according to claim 1, wherein the ON/OFF controller further includes a first current control integrated circuit (IC) for controlling current flowing in the light emitting cell.

3. The light emitting module according to claim 1, further comprising a first surge protection unit disposed between the N-th light emitting element package and the current level regulator to protect the light emitting module from a surge voltage less than or equal to a predetermined voltage.

4. The light emitting module according to claim 3, wherein:

the first surge protection unit includes a field effect transistor, the field effect transistor includes:

a drain connected to the N-th light emitting element package;

a gate receiving the external driving voltage; and a source connected to the current level regulator.

5. The light emitting module according to claim 1, further comprising a rectifier rectifying the alternating current (AC) external driving voltage and supplying the rectified external driving voltage to the first to N-th light emitting element packages.

6. The light emitting module according to claim 5, further comprising a second surge protection unit connected to the rectifier in parallel to protect the light emitting module from a surge voltage greater than the predetermined voltage.

7. The light emitting module according to claim 6, wherein the second surge protection unit includes a varistor connected to the rectifier in parallel.

8. The light emitting module according to claim 5, further comprising a fuse disposed between the AC external driving voltage and the rectifier.

9. The light emitting module according to claim 5, further comprising:

a Zener resistor having one side connected to a first node between the rectifier and the first light emitting element package; and a Zener diode having an anode connected to the other side of the Zener resistor and a cathode connected to the current level regulator.

10. The light emitting module according to claim 1, wherein the plurality of sub cells includes:

a first sub cell having a plurality of light emitting elements connected to each other in parallel; and a second sub cell connected to the first sub cell in series and having a plurality of light emitting elements connected to each other in parallel.

11. The light emitting module according to claim 1, wherein the ON/OFF controller further includes:

a first switching element connected between a node between the plurality of sub cells and an output terminal of the light emitting cell to perform switching in response to a first switching control signal;

a first comparator comparing a voltage of the output terminal of the light emitting cell and the first reference voltage, and outputting a comparison result as the first switching control signal;

and a first current source connected between the output terminal of the light emitting cell and the output terminal of the ON/OFF controller.

12. The light emitting module according to claim 11, wherein the ON/OFF controller further includes a first mode selector controlling current of the first current source.

13. The light emitting module according to claim 4, wherein the current level regulator includes:

a second current regulation resistor;

a second switching element connected between the source and one side of the second current regulation resistor to perform switching in response to a second switching control signal;

a second comparator comparing a voltage of one side of the second current regulation resistor with a second reference voltage, and outputting a comparison result as the second switching control signal;

a second reference voltage generator generating the second reference voltage using a voltage between the source and the other side of the second current regulation resistor; and a second current source connected between both sides of the second current regulation resistor.

14. The light emitting module according to claim 13, further comprising a second mode selector controlling current of the second current source.

15. The light emitting module according to claim 5, further comprising a valley-fill circuit reducing and outputting a level difference between a maximum value and a minimum value of the rectified external driving voltage.

16. The light emitting module according to claim 15, wherein the valley-fill circuit includes:

a first diode having an anode connected to a low potential of the rectified external driving voltage;

a first capacitor connected between a high potential of the rectified external driving voltage and a cathode of the first diode;

a second diode having an anode connected to the cathode of the first diode;

a third diode having an anode and a cathode respectively connected to the cathode of the second diode and the high potential of the rectified external driving voltage; and a second capacitor connected between the cathode of the second diode and the low potential of the rectified external driving voltage.

17. The light emitting module according to claim 15, further comprising a first surge protection circuit disposed between the valley-fill circuit and the first light emitting element package to protect the light emitting module from a surge voltage equal to or less than a predetermined voltage.

18. The light emitting module according to claim 1, further comprising a first surge protection circuit disposed between the first light emitting element package and the second light emitting element package to protect the light emitting module from a surge voltage equal to or less than a predetermined voltage.

19. The light emitting module according to claim 15, wherein the level difference is reduced by a predetermined level and the predetermined level is 40% to 50% of the level difference.

20. A light emitting module comprising:

first to N-th (where N being a positive integer equal to or greater than 1) light emitting element packages electrically connected to each other;

a rectifier rectifying an alternating current (AC) external driving voltage; and a valley-fill circuit reducing a difference between a maximum value and a minimum value of the external driving voltage rectified by the rectifier, and outputting the external driving voltage having the reduced level to the first to N-th light emitting element packages, wherein each of the first to N-th light emitting element packages includes:

a light emitting cell, each of the light emitting cell including at least one light emitting element and including a plurality of sub cells connected to each other in series or in parallel; and an ON/OFF controller connected between the plurality of sub cells and selectively forming a path in which current flows in the light emitting cell according to the reduced level of the external driving voltage, wherein the ON/OFF controller comprises a first reference voltage generator generating a first reference voltage using a voltage between a node between the sub cells and an output terminal of the ON/OFF controller, and wherein the ON/OFF controller selectively forms the path, through which current flows, in the light emitting cell by using the first reference voltage.

* * * * *